US009745889B2

(12) United States Patent
Naik et al.

(10) Patent No.: US 9,745,889 B2
(45) Date of Patent: Aug. 29, 2017

(54) SYSTEM AND METHOD FOR CONTROLLING COOLANT FLOW THROUGH AN ENGINE USING A FEEDFORWARD APPROACH AND A FEEDBACK APPROACH

(71) Applicant: GM Global Technology Operations LLC, Detroit, MI (US)

(72) Inventors: Sanjeev M. Naik, Troy, MI (US); Yue-Ming Chen, Ann Arbor, MI (US); Irina N. Dmitrieva, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 53 days.

(21) Appl. No.: 14/790,384

(22) Filed: Jul. 2, 2015

(65) Prior Publication Data

US 2017/0002720 A1 Jan. 5, 2017

(51) Int. Cl.
*F01P 7/16* (2006.01)
*F01P 5/10* (2006.01)
(Continued)

(52) U.S. Cl.
CPC ..... *F01P 7/167* (2013.01); *F01P 3/02* (2013.01); *F01P 3/20* (2013.01); *F01P 5/10* (2013.01);
(Continued)

(58) Field of Classification Search
CPC .... F01P 7/167; F01P 2025/62; F01P 2025/31; F01P 2025/60; F01P 2023/08;
(Continued)

(56) References Cited

U.S. PATENT DOCUMENTS 3,817,224 A 6/1974 Pluequet et al.
4,616,599 A * 10/1986 Taguchi ..... F01P 7/167 123/41.1
(Continued)

FOREIGN PATENT DOCUMENTS

CN 102076937 A 5/2011
DE 19728351 A1 1/1999
(Continued)

OTHER PUBLICATIONS

Glossary of Judicial Claim Constructions in the Electronics, Computer and Business Method Arts.
(Continued)

*Primary Examiner* — Stephen K Cronin
*Assistant Examiner* — Long T Tran

(57) ABSTRACT

A system according to the principles of the present disclosure includes a heat transfer rate module, a desired flow rate module, a flow rate adjustment module, and a pump control module. The heat transfer rate module determines a rate of heat transfer from an engine to coolant flowing through the engine based on a cylinder wall temperature and a measured coolant temperature. The desired flow rate module determines a desired rate of coolant flow through the engine based on the heat transfer rate. The flow rate adjustment module determines a coolant flow rate adjustment based on a desired coolant temperature and the measured coolant temperature. The pump control module controls a coolant pump to adjust an actual rate of coolant flow through the engine based on the desired coolant flow rate and the coolant flow rate adjustment.

20 Claims, 3 Drawing Sheets

(51) Int. Cl.

| | |
|---|---|
| ***F04B 49/02*** | (2006.01) |
| ***F04B 51/00*** | (2006.01) |
| ***F01P 5/14*** | (2006.01) |
| ***F01P 3/02*** | (2006.01) |
| ***F01P 3/20*** | (2006.01) |
| *F01P 3/00* | (2006.01) |

(52) U.S. Cl.
CPC ..... *F01P 5/14* (2013.01); *F01P 7/164* (2013.01); *F04B 49/02* (2013.01); *F04B 51/00* (2013.01); *F01P 2003/001* (2013.01); *F01P 2003/021* (2013.01); *F04B 2203/0605* (2013.01)

(58) Field of Classification Search
CPC .... F01P 2023/00; F01P 2037/00; F01P 7/164; F01P 3/20; F01P 2003/001
USPC ..... 123/41.08; 701/101–104
See application file for complete search history.

(56) References Cited

U.S. PATENT DOCUMENTS

| | | | | |
|---|---|---|---|---|
| 5,390,632 | A * | 2/1995 | Ikebe | F01P 7/164 123/41.02 |
| 5,754,971 | A | 5/1998 | Matsumoto et al. | |
| 6,169,953 | B1 | 1/2001 | Panoushek et al. | |
| 6,343,572 | B1 | 2/2002 | Pfaff et al. | |
| 6,397,820 | B1 | 6/2002 | Novak et al. | |
| 6,668,766 | B1 | 12/2003 | Liederman et al. | |
| 6,745,726 | B2 | 6/2004 | Joyce et al. | |
| 6,758,172 | B2 | 7/2004 | Morgan et al. | |
| 6,802,283 | B2 | 10/2004 | Liederman et al. | |
| 6,866,092 | B1 * | 3/2005 | Molivadas | F01L 3/12 123/41.2 |
| 7,263,954 | B2 * | 9/2007 | Piddock | F01P 7/167 123/41.02 |
| 7,409,928 | B2 | 8/2008 | Rizoulis et al. | |
| 7,997,510 | B2 | 8/2011 | Pavia et al. | |
| 8,224,517 | B2 | 7/2012 | Eser et al. | |
| 8,813,692 | B2 | 8/2014 | Bialas et al. | |
| 8,813,693 | B2 | 8/2014 | Bialas et al. | |
| 2006/0162677 | A1 * | 7/2006 | Piddock | F01P 7/167 123/41.1 |
| 2010/0038158 | A1 | 2/2010 | Whitney et al. | |
| 2011/0098883 | A1 | 4/2011 | Eser et al. | |
| 2011/0120216 | A1 | 5/2011 | Sugimoto | |
| 2012/0215397 | A1 | 8/2012 | Anilovich et al. | |
| 2013/0089436 | A1 | 4/2013 | Bialas et al. | |
| 2014/0072450 | A1 | 3/2014 | Levijoki | |
| 2014/0230761 | A1 * | 8/2014 | Pilavdzic | F01P 3/22 123/41.21 |
| 2014/0230762 | A1 * | 8/2014 | Nakashima | F01L 1/3442 123/90.12 |

FOREIGN PATENT DOCUMENTS

| | | | |
|---|---|---|---|
| DE | 10316753 | A1 | 10/2003 |
| DE | 10334501 | A1 | 3/2004 |
| DE | 102008032130 | A1 | 1/2010 |
| DE | 102012208003 | A1 | 11/2012 |
| DE | 102012218133 | A1 | 4/2013 |

OTHER PUBLICATIONS

U.S. Appl. No. 14/790,387, filed Jul. 2002, Naik et al.
Non-Final Office Action dated Jan. 6, 2014 in U.S. Appl. No. 13/269,048; 6 pages.
Non-Final Office Action dated Jan. 3, 2014 in U.S. Appl. No. 13/111,318; 5 pages.
Office Action dated Feb. 23, 2015, from the German Patent Office for German Patent Application No. 10 2013 217 253.2; 4 pages.

* cited by examiner

SYSTEM AND METHOD FOR CONTROLLING COOLANT FLOW THROUGH AN ENGINE USING A FEEDFORWARD APPROACH AND A FEEDBACK APPROACH

CROSS-REFERENCE TO RELATED APPLICATIONS

This application is related to U.S. patent application Ser. No. 13/606,565 filed on Sep. 7, 2012, and Ser. No. 14/790,387 filed on Jul. 2, 2015. The entire disclosures of the above applications are incorporated herein by reference.

FIELD

The present disclosure relates to internal combustion engines, and more specifically, to systems and methods for controlling coolant flow through an engine using a feedforward approach and a feedback approach.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A cooling system for an engine typically includes a radiator, a coolant pump, an inlet line, and an outlet line. The inlet line extends to an inlet of the engine from an outlet of the radiator. The outlet line extends from an outlet of the engine to an inlet of the radiator. The coolant pump circulates coolant through the inlet line, the engine, the outlet line, and the radiator. In some cases, the cooling system includes a bypass valve that allows coolant to bypass the radiator when the bypass valve is open.

An engine control system typically controls coolant flow through the engine by adjusting the speed of the coolant pump. Conventional engine controls systems adjust the coolant flow to minimize the difference between a desired coolant temperature and a measured coolant temperature. Controlling coolant flow in this way may be referred to as a feedback approach.

Controlling coolant flow using only the feedback approach may be adequate during steady-state conditions, such as when a vehicle is traveling at a constant speed. However, controlling coolant flow using only the feedback approach may not adjust the coolant temperature as quickly and as accurately as desired during transient conditions, such as when a vehicle is accelerating.

SUMMARY

A system according to the principles of the present disclosure includes a heat transfer rate module, a desired flow rate module, a flow rate adjustment module, and a pump control module. The heat transfer rate module determines a rate of heat transfer from an engine to coolant flowing through the engine based on a cylinder wall temperature and a measured coolant temperature. The desired flow rate module determines a desired rate of coolant flow through the engine based on the heat transfer rate. The flow rate adjustment module determines a coolant flow rate adjustment based on a desired coolant temperature and the measured coolant temperature. The pump control module controls a coolant pump to adjust an actual rate of coolant flow through the engine based on the desired coolant flow rate and the coolant flow rate adjustment.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A system and method according to the present disclosure controls coolant flow through an engine using both a feedforward approach and a feedback approach. In the feedback approach, the system and method determines a coolant flow rate adjustment based on a difference between a desired coolant temperature and a measured coolant temperature. In the feedforward approach, the system and method determines a desired coolant flow rate based on an actual rate of heat transfer from the engine to coolant flowing through the engine. The system and method then controls the speed of a coolant pump to minimize the difference between an actual coolant flow rate and a sum of the desired coolant flow rate and the coolant flow rate adjustment.

The system and method may determine the rate of heat transfer from the engine to coolant flowing through the engine using a mathematical model. In one example, the system and method determines the heat transfer rate based on a temperature of a cylinder wall in the engine and an average value of a coolant inlet temperature and a coolant outlet temperature. The system and method may also determine the heat transfer rate based on physical properties of the cylinder wall and the coolant, such as mass, specific heat, heat transfer coefficient, and/or surface area.

Controlling the coolant flow through the engine using both a feedforward approach and a feedback approach improves the system response time relative to controlling the coolant flow using only the feedback approach. In addition, controlling the coolant flow using the feedback approach corrects for any errors associated with the mathematical model used in the feedforward approach. Thus, the system and method according to the present disclosure adjusts the coolant flow to accurately and quickly control the coolant temperature in both steady-state and transient conditions.

Figure 1:
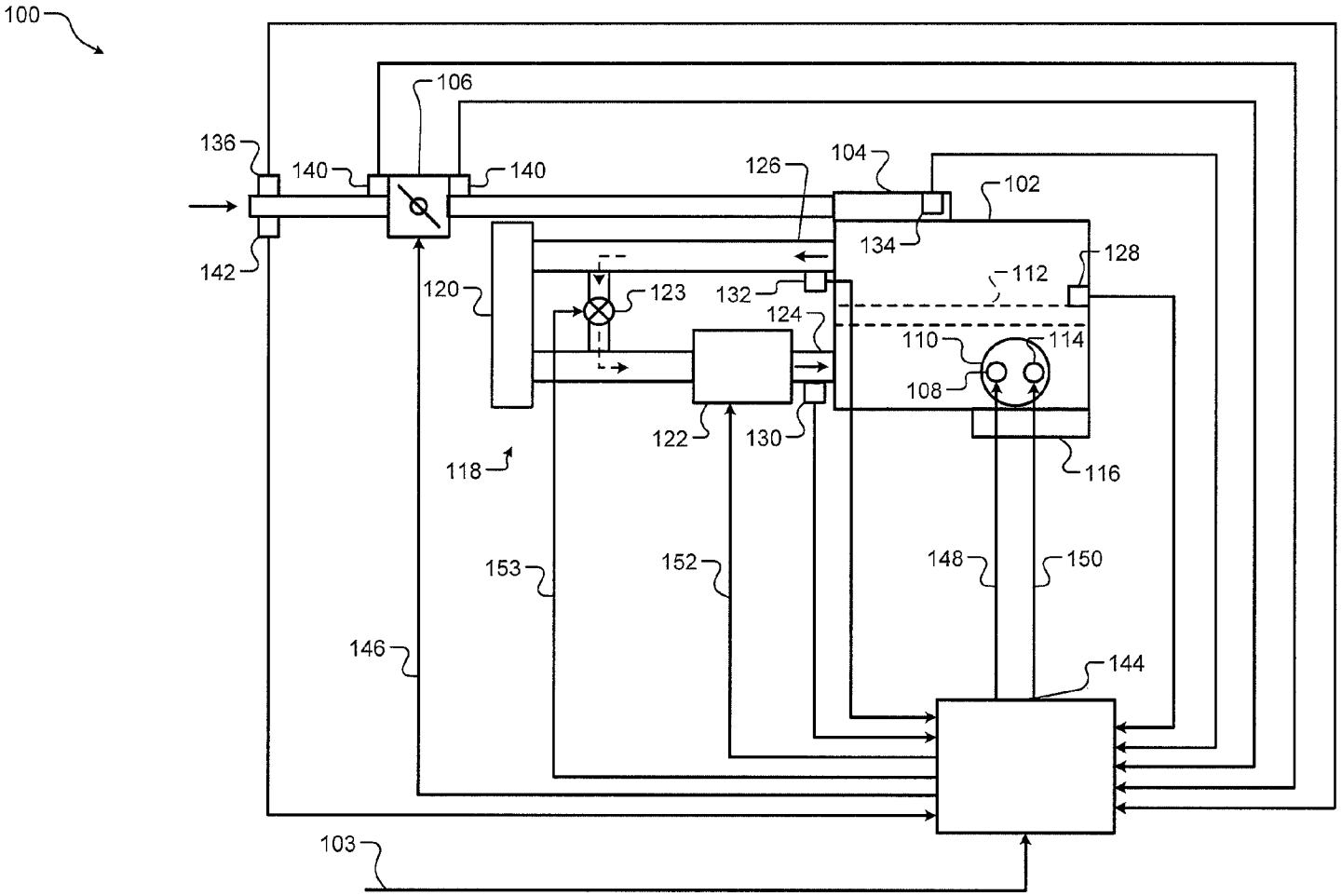
FIG. 1 is a functional block diagram of an example engine system according to the principles of the present disclosure.

Referring now to FIG. 1, an engine system 100 includes an engine 102 that combusts an air/fuel mixture to produce drive torque for a vehicle. The amount of drive torque produced by the engine 102 is based on a driver input 103. The driver input 103 may be generated based on a position of an accelerator pedal. The driver input 103 may also be generated by a cruise control system, which may be an adaptive cruise control system that varies vehicle speed to maintain a predetermined following distance.

Air is drawn into the engine 102 through an intake manifold 104. The amount of air drawn into the engine 102 may be varied using a throttle valve 106. One or more fuel injectors, such as a fuel injector 108, inject fuel into the air to form an air/fuel mixture. The air/fuel mixture is combusted within cylinders of the engine 102, such as a cylinder 110. Although the engine 102 is depicted as including one cylinder, the engine 102 may include more than one cylinder.

The cylinder 110 includes a piston (not shown) that is mechanically linked to a crankshaft 112. One combustion cycle within the cylinder 110 may include four phases: an intake phase, a compression phase, a combustion phase, and an exhaust phase. During the intake phase, the piston moves toward a bottommost position and draws air into the cylinder 110. During the compression phase, the piston moves toward a topmost position and compresses the air or air/fuel mixture within the cylinder 110.

During the combustion phase, spark from a spark plug 114 ignites the air/fuel mixture. The combustion of the air/fuel mixture drives the piston back toward the bottommost position, and the piston drives rotation of the crankshaft 112. During the exhaust phase, exhaust gas is expelled from the cylinder 110 through an exhaust manifold 116 to complete the combustion cycle. The engine 102 outputs torque to a transmission (not shown) via the crankshaft 112. Although the engine 102 is described as a spark-ignition engine, the engine 102 may be a compression-ignition engine.

A cooling system 118 for the engine 102 includes a radiator 120, a coolant pump 122, and a bypass valve 123. The radiator 120 cools coolant that flows through the radiator 120, and the coolant pump 122 circulates coolant through the engine 102 and the radiator 120. Coolant flows from the radiator 120 to the coolant pump 122, from the coolant pump 122 to the engine 102 through an inlet line 124, and from the engine 102 back to the radiator 120 through an outlet line 126.

The coolant pump 122 may be a switchable water pump. In one example, the coolant pump 122 is a centrifugal pump including an impeller and a clutch that selectively engages the impeller with a pulley driven by a belt connected to the crankshaft 112. The clutch engages the impeller with the pulley and disengages the impeller from the pulley when the coolant pump 122 is switched on and off, respectively. Coolant may enter the coolant pump 122 through an inlet located near the center of the coolant pump 122, and the impeller may force the coolant radially outward to an outlet located at the outside of the coolant pump 122. Alternatively, the coolant pump 122 may be an electric pump.

The bypass valve 123 may be opened to allow coolant to bypass the radiator 120 as the coolant flows from the outlet line 126 to the inlet line 124. The bypass valve 123 may be adjusted to a fully closed position, a fully opened position, and to partially open positions (i.e., positions between the fully closed position and the fully open position. When the bypass valve 123 is adjusted to a partially open position, part of the coolant flow exiting the engine 102 passes through the radiator 120 and part of the coolant flow exiting the engine 102 passes through the bypass valve 123.

A crankshaft position (CKP) sensor 128 measures the position of the crankshaft 112, which may be used to determine the speed of the engine 102. A coolant inlet temperature (CIT) sensor 130 measures the temperature of coolant entering the engine 102, which is referred to as a coolant inlet temperature. A coolant outlet temperature (COT) sensor 132 measures the temperature of coolant exiting the engine 102, which is referred to as a coolant outlet temperature. The CIT sensor 130 and the COT sensor 132 may be located within the inlet line 124 and the outlet line 126, respectively, or at other locations where coolant is circulated, such as in a coolant passage (not shown) of the engine 102 and/or in the radiator 120.

The pressure within the intake manifold 104 may be measured using a manifold absolute pressure (MAP) sensor 134. In various implementations, engine vacuum, which is the difference between ambient air pressure and the pressure within the intake manifold 104, may be measured. The mass flow rate of air flowing into the intake manifold 104 may be measured using a mass air flow (MAF) sensor 136. In various implementations, the MAF sensor 136 may be located in a housing that also includes the throttle valve 106.

The position of the throttle valve 106 may be measured using one or more throttle position sensors (TPS) 140. The ambient temperature of air being drawn into the engine 102 may be measured using an intake air temperature (IAT) sensor 142. An engine control module (ECM) 144 controls the throttle valve 106, the fuel injector 108, and the spark plug 114, and the coolant pump 122 based on signals from the sensors.

The ECM 144 outputs a throttle control signal 146 to control the position of the throttle valve 106. The ECM 144 outputs a fuel control signal 148 to control the opening timing and duration of the fuel injector 108. The ECM 144 outputs a spark control signal 150 to control spark timing of the spark plug 114. The ECM 144 outputs a pump control signal 152 to control the speed of the coolant pump 122. The ECM 144 outputs a valve control signal 153 to control the opening area of the bypass valve 123.

The ECM 144 controls the coolant pump 122 to adjust the actual rate of coolant flow through the engine 102 based on a desired rate of coolant flow through the engine 102 and a coolant flow rate adjustment. The ECM 144 determines the coolant flow rate adjustment based on a difference between a desired coolant outlet temperature and the coolant outlet temperature from the COT sensor 132. The ECM 144 determines the desired coolant flow rate based on a rate of heat transfer from the engine 102 to coolant flowing through the engine 102. The ECM 144 determines the heat transfer rate based on a temperature of a cylinder wall in the engine 102, the coolant inlet and outlet temperatures from the CIT and COT sensors 130 and 132, and physical properties of the cylinder wall and the coolant.

Figure 2:
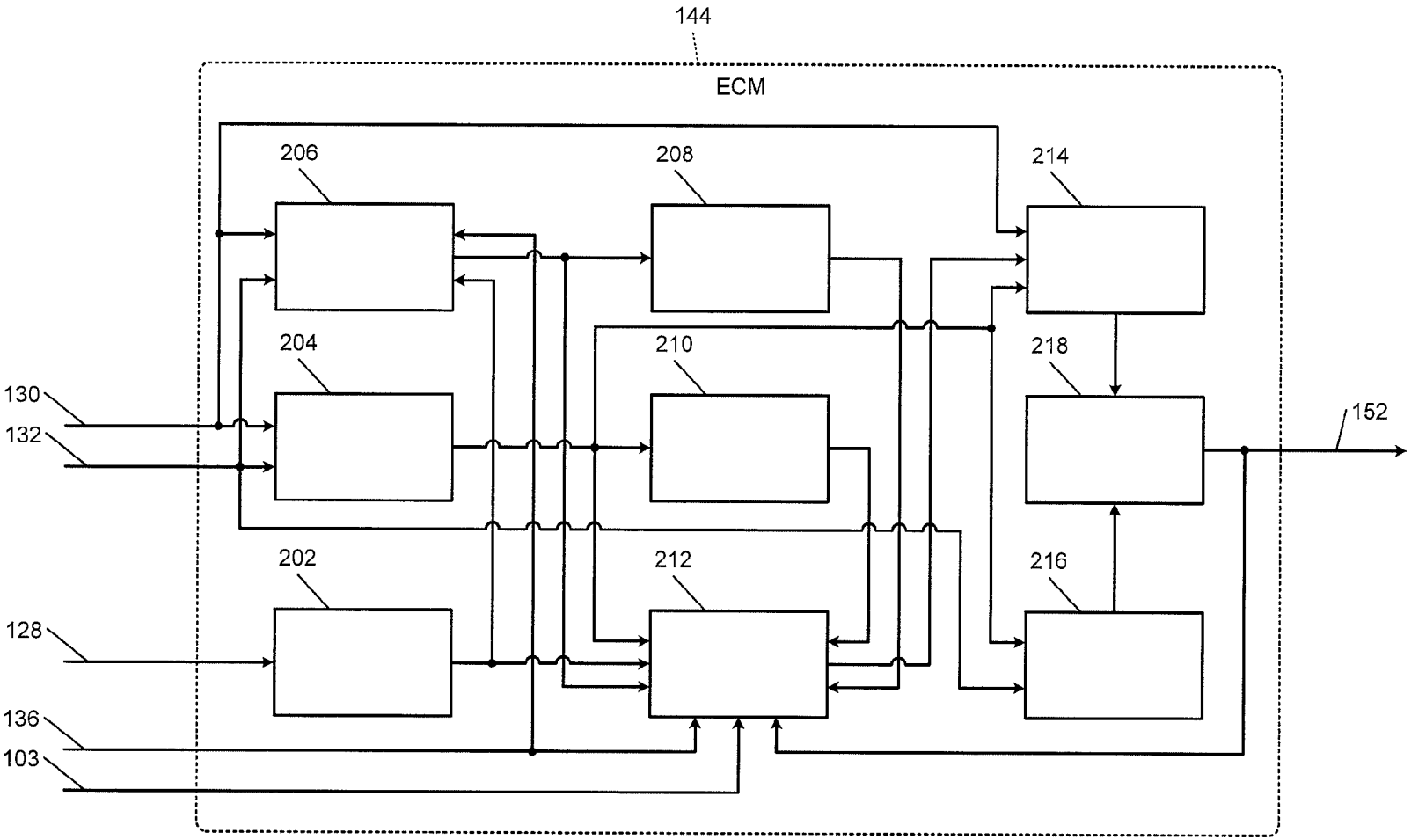
FIG. 2 is a functional block diagram of an example control system according to the principles of the present disclosure.

Referring now to FIG. 2, an example implementation of the ECM 144 includes an engine speed module 202 that determines the speed of the engine 102. The engine speed module 202 may determine the engine speed based on the crankshaft position from the CKP sensor 128. For example, the engine speed module 202 may calculate the engine speed based on a period that elapses as the crankshaft completes one or more revolutions. The engine speed module 202 outputs the engine speed.

A coolant temperature module 204 determines an average temperature of coolant flowing through the engine 102. The average coolant temperature is an average value of the coolant inlet temperature from the CIT sensor 130 and the coolant outlet temperature from the COT sensor 132. The coolant temperature module 204 outputs the average coolant temperature.

A cylinder wall temperature module 206 estimates a temperature of a cylinder wall in the engine 102 based on engine operating conditions. The engine operating conditions may include the engine speed, the coolant inlet temperature, the coolant outlet temperature, the mass flow rate of intake air from the MAF sensor 136, and/or an engine operating period. The cylinder wall temperature module 206 may estimate the cylinder wall temperature based on a predetermined relationship between the engine operating conditions and the cylinder wall temperature. The predetermined relationship may be embodied in a lookup table and/or an equation. The cylinder wall temperature module 206 outputs the cylinder wall temperature.

An engine heat absorption module 208 determines an actual rate of change in heat absorbed by the engine 102. Components of the engine 102 (e.g., a cylinder wall) absorb heat resulting from combustion of air and fuel within cylinders of the engine 102. The engine heat absorption module 208 determines the rate of change in this heat absorption based on a change in the cylinder wall temperature and a period associated therewith. For example, the engine heat absorption module 208 may determine the rate of change in the heat absorbed by the engine 102 using a relationship such as $$\dot{Q}_{eng} = m_w c_{pw} \frac{\Delta T_w}{\Delta t} \tag{1}$$

where $\dot{Q}_{eng}$ is the rate of change in the heat absorbed by the engine 102, $m_w$ is the mass of the cylinder wall, $c_{pw}$ is the specific heat of the cylinder wall, $\Delta T_w$ is a change in the cylinder wall temperature over a period, and $\Delta t$ is the period. The engine heat absorption module 208 outputs the rate of change in heat absorbed by the engine 102.

A coolant heat absorption module 210 determines an actual rate of change in heat absorbed by coolant flowing through the engine 102. The coolant heat absorption module 210 determines the rate of change in heat absorbed by the coolant based on a change in the average coolant temperature and a period associated therewith. For example, the coolant heat absorption module 210 may determine the rate of change in the heat absorbed by the coolant using a relationship such as $$\dot{Q}_c = m_c c_{pc} \frac{(\Delta T_c)_{avg}}{\Delta t} \tag{2}$$

where $\dot{Q}_c$ is the rate of change in the heat absorbed by the coolant, $m_c$ is the mass of the coolant, $c_{pc}$ is the specific heat of the coolant, $(\Delta T_c)_{avg}$ is a change in the average coolant temperature over a period, and $\Delta t$ is the period. The coolant heat absorption module 210 outputs the rate of change in heat absorbed by the coolant.

A heat transfer rate module 212 determines a rate of heat transfer from the engine 102 to coolant flowing through the engine 102. The heat transfer rate module 212 may determine this heat transfer rate using a relationship such as $$\dot{Q}_{eng\to c} = (\dot{Q}_{rej})_{des} - \dot{Q}_{eng} - \dot{Q}_c \tag{3}$$

where $\dot{Q}_{eng\to c}$ is the rate of heat transfer from the engine 102 to the coolant and $(\dot{Q}_{rej})_{des}$ is a desired rate of heat rejection from the engine 102.

The heat transfer rate module 212 may determine the desired heat rejection rate based on the engine speed and an amount of air delivered to each cylinder of the engine 102, which may be referred to as the air per cylinder. Alternatively, the heat transfer rate module 212 may determine the desired heat rejection rate based on the engine speed and a desired torque output of the engine 102. The heat transfer rate module 212 outputs the desired rate of heat rejection from the engine 102.

The ECM 144 may divide the mass flow rate of intake air from the MAF sensor 136 by the number of cylinders in the engine 102 to obtain the air per cylinder. The ECM 144 may determine the desired torque output of the engine 102 based on the driver input 103. In one example, the ECM 144 stores one or more mappings of accelerator pedal position to desired torque and determines the desired torque output of the engine 102 based on a selected one of the mappings.

In various implementations, the heat transfer rate module 212 may determine the heat transfer rate from the engine 102 to coolant flowing through the engine 102 using a relationship such as $$\dot{Q}_{eng\to c} = h_w A_w [T_w - (T_c)_{avg}] \tag{4}$$

where $\dot{Q}_{eng\to c}$ is the heat transfer rate, $h_w$ is a heat transfer coefficient of the cylinder wall, $A_w$ is a surface area of the cylinder wall, $T_w$ is the cylinder wall temperature, and $(T_c)_{avg}$ is the average coolant temperature.

In various implementations, the heat transfer rate module 212 may determine the heat transfer rate from the engine 102 to coolant flowing through the engine 102 using a relationship such as $$\dot{Q}_{eng\to c} = [K_{HEX,0} + K_{HEX,1} * (\dot{m}_c)_{act}] * [T_w - (T_c)_{avg}] \tag{5}$$

where $\dot{Q}_{eng\to c}$ is the heat transfer rate, $K_{HEX,0}$ and $K_{HEX,1}$ are effective heat transfer coefficients of the cylinder wall, $(\dot{m}_c)_{act}$ is the actual mass flow rate of the coolant, $T_w$ is the cylinder wall temperature, and $(T_c)_{avg}$ is the average coolant temperature. The heat transfer rate module 212 may estimate the actual mass flow rate of the coolant based on the speed of the coolant pump 122. The heat transfer rate module 212 may assume that the speed of the coolant pump 122 is equal to a commanded pump speed indicated by the pump control signal 152. The heat transfer rate module 212 outputs the heat transfer rate from the engine 102 to coolant flowing through the engine 102.

A desired flow rate module 214 determines a desired rate of coolant flow through the engine 102. The desired flow rate module 214 may determine the desired coolant flow rate using a relationship such as $$(\dot{m}_c)_{des} = \frac{\dot{Q}_{eng\to c}}{c_{pc}[(T_{out})_{des} - T_{in}]} \tag{6}$$

where $(\dot{m}_c)_{des}$ is a desired mass flow rate of coolant flow through the engine 102, $\dot{Q}_{eng\to c}$ is the heat transfer rate from the engine 102 to coolant flowing through the engine 102, $c_{pc}$ is the specific heat of the coolant, $(T_{out})_{des}$ is a desired coolant outlet temperature, and $T_{in}$ is the coolant inlet temperature from the CIT sensor 130. The desired flow rate module 214 outputs the desired coolant flow rate.

The coolant temperature module 204 may determine the desired coolant outlet temperature using a mapping of engine torque and engine speed to coolant outlet temperature. The mapping may be predetermined (e.g., calibrated) to maximize the efficiency of the engine 102. The desired coolant outlet temperature obtained from the mapping may be adjusted to be within predetermined limits if the desired coolant outlet temperature is outside of the limits. The limits may include a lower limit for heating the engine 102 at engine startup and an upper limit for preventing engine overheating.

Relationships (1), (2) and (3) may be substituted into relationship (6) to obtain the following relationship $$(\dot{m}_c)_{des} = \frac{(\dot{Q}_{rej})_{des} - m_w c_{pw}\frac{\Delta T_w}{\Delta t} - m_c c_{pc}\frac{(\Delta T_c)_{avg}}{\Delta t}}{c_{pc}[(T_{out})_{des} - T_{in}]} \quad (7)$$

Relationship (4) may be substituted into relationship (6) to obtain the following relationship $$(\dot{m}_c)_{des} = \frac{h_w A_w[T_w - (T_c)_{avg}]}{c_{pc}[(T_{out})_{des} - T_{in}]} \quad (8)$$

Relationship (5) may be substituted into relationship (6) to obtain the following relationship $$(\dot{m}_c)_{des} = \frac{[K_{HEX,0} + K_{HEX,1} * (\dot{m}_c)_{act}] * [T_w - (T_c)_{avg}]}{c_{pc}[(T_{out})_{des} - T_{in}]} \quad (9)$$

The desired mass flow rate of coolant flow $(\dot{m}_c)_{des}$ may be used in place of the actual mass flow rate of coolant $(\dot{m}_c)_{act}$ in relationship (9), and the relationship may be rearranged to solve for the desired mass flow rate of coolant flow as follows $$(\dot{m}_c)_{des} = \frac{K_{HEX,0} * [T_w - (T_c)_{avg}]}{c_{pc}[(T_{out})_{des} - T_{in}] - K_{HEX,1} * [T_w - (T_c)_{avg}]} \quad (10)$$

A flow rate adjustment module 216 determines a coolant flow rate adjustment based on a difference between a desired coolant temperature and a measured coolant temperature. The desired coolant temperature may be the desired coolant outlet temperature determined by the coolant temperature module 204. The measured coolant temperature may be the coolant outlet temperature from the COT sensor 132. The flow rate adjustment module 216 outputs the coolant flow rate adjustment.

A pump control module 218 outputs the pump control signal 152 to control the speed of the coolant pump 122. The pump control module 218 may control the speed of the coolant pump 122 to adjust an actual rate of coolant flow through the engine 102 based on the desired coolant flow rate and the coolant flow rate adjustment. In one example, the pump control module 218 controls the speed of the coolant pump 122 to minimize a difference between the actual coolant flow rate and a sum of the desired coolant flow rate and the coolant flow rate adjustment.

Figure 3:
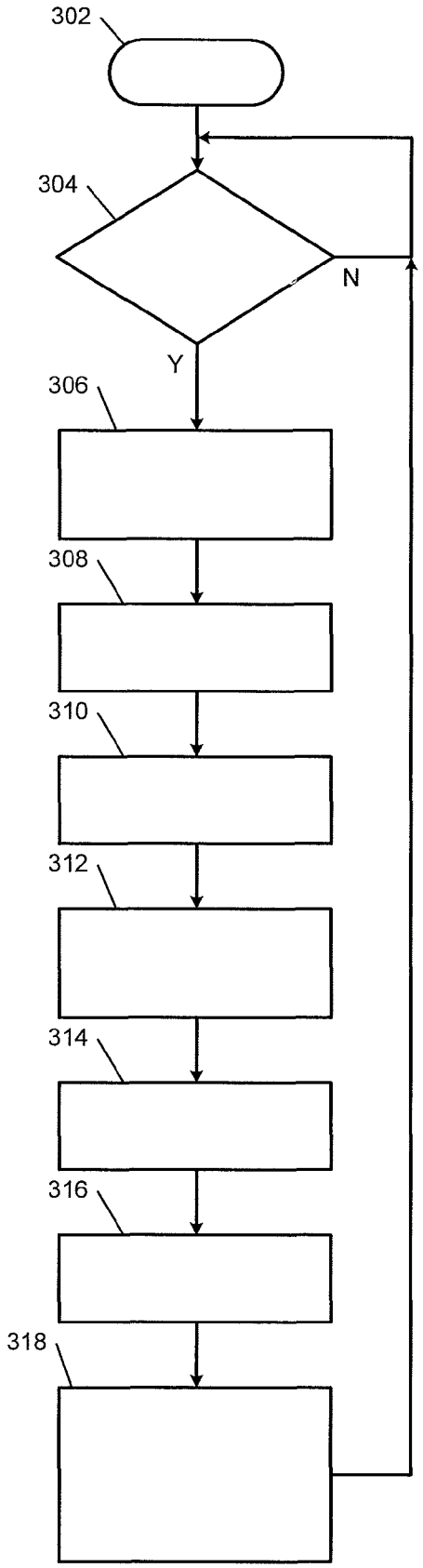
FIG. 3 is a flowchart illustrating an example control method according to the principles of the present disclosure.

Referring now to FIG. 3, a method for controlling coolant flow through an engine begins at 302. The method is described in the context of the modules in the example implementation of the ECM 144 shown in FIG. 2. However, the particular modules that perform the steps of the method may be different than the modules mentioned below and/or the method may be implemented apart from the modules of FIG. 2.

At 304, the desired flow rate module 214 determines whether the engine system 100 is operating in a demand coolant mode. If the engine system 100 is operating in the demand coolant mode, the method continues at 306. Otherwise, the desired flow rate module 214 continues to determine whether the engine system 100 is operating in a demand coolant mode.

The engine system 100 may be operating in the demand coolant mode when the ECM 144 is actively controlling coolant flow through the engine 102 to adjust the temperature of the coolant. For example, the engine system 100 may be operating in the demand coolant mode when the actual flow rate of the coolant is greater than zero. The actual flow rate of the coolant may be assumed to be greater than zero when the commanded pump speed indicated by the pump control signal 152 is greater than zero.

At 306, the coolant temperature module 204 determines the desired coolant outlet temperature. At 308, the coolant temperature module 204 determines the average coolant temperature. At 310, the cylinder wall temperature module 206 estimates the cylinder wall temperature.

At 312, the heat transfer rate module 212 determines the rate of heat transfer from the engine 102 to coolant flowing through the engine 102. The heat transfer rate module 212 may use relationships (3), (4), or (5) to determine the heat transfer rate. If relationship (3) is used, the heat transfer rate module 212 may determine the desired rate of heat rejection from the engine 102. In addition, the engine heat absorption module 208 may determine the actual rate of change in heat absorbed by the engine 102, and the coolant heat absorption module 210 may determine the actual rate of change in heat absorbed by coolant flowing through the engine 102.

At 314, the desired flow rate module 214 determines the desired flow rate of coolant flow through the engine 102. The desired flow rate module 214 may use relationship (6) to determine the desired coolant flow rate. Alternatively, the desired flow rate module 214 may use relationship (7), (8), (9), or (10) to determine the desired coolant flow rate. In this latter case, the heat transfer rate module 212 may not determine the heat transfer rate (i.e., 312 may be omitted from the method).

At 316, the flow rate adjustment module 216 determines the coolant flow rate adjustment. At 318, the pump control module 218 controls the coolant pump 122 based on the desired coolant flow rate and the coolant flow rate adjustment. In one example, the pump control module 218 controls the speed of the coolant pump 122 to minimize a difference between the actual coolant flow rate and a sum of the desired coolant flow rate and the coolant flow rate adjustment.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a heat transfer rate module that determines a rate of heat transfer from an engine to coolant flowing through the engine based on a cylinder wall temperature and a measured coolant temperature;

a desired flow rate module that determines a desired rate of coolant flow through the engine based on the heat transfer rate;

a flow rate adjustment module that determines a coolant flow rate adjustment based on a desired coolant temperature and the measured coolant temperature; and a pump control module that controls a coolant pump to adjust an actual rate of coolant flow through the engine based on the desired coolant flow rate and the coolant flow rate adjustment.

2. The system of claim 1 wherein the pump control module controls the coolant pump to adjust the actual coolant flow rate to a sum of the desired coolant flow rate and the coolant flow rate adjustment.

3. The system of claim 1 wherein the heat transfer rate module determines the heat transfer rate based on a desired rate of heat rejection from the engine minus:

a rate of change in heat absorbed by the engine; and a rate of change in heat absorbed by coolant flowing through the engine.

4. The system of claim 3 wherein the heat transfer rate module determines the desired rate of heat rejection from the engine based on a speed of the engine and at least one of a desired torque output of the engine and an amount of air delivered to a cylinder of the engine.

5. The system of claim 3 further comprising an engine heat absorption module that determines the rate of change in heat absorbed by the engine based on a product of:

a cylinder wall mass;

a cylinder wall specific heat;

a change in the cylinder wall temperature; and a period associated with the change in the cylinder wall temperature.

6. The system of claim 3 further comprising a coolant heat absorption module that determines the rate of change in heat absorbed by coolant flowing through the engine based on a product of:

a coolant mass;

a coolant specific heat;

a change in the measured coolant temperature; and a period associated with the change in the measured coolant temperature.

7. The system of claim 1 wherein the heat transfer rate module determines the heat transfer rate based on a product of:

a heat transfer coefficient of a cylinder wall of the engine;

a surface area of the cylinder wall; and a difference between the cylinder wall temperature and the measured coolant temperature.

8. The system of claim 1 wherein the heat transfer rate module determines the heat transfer rate based on a product of:

an effective heat transfer coefficient of a cylinder wall of the engine; and a difference between the cylinder wall temperature and the measured coolant temperature.

9. The system of claim 1 further comprising a cylinder wall temperature module that estimates the cylinder wall temperature based on engine operating conditions.

10. The system of claim 1 wherein:

the heat transfer rate module determines the heat transfer rate based on the cylinder wall temperature and an average value of a measured temperature of coolant entering the engine and a measured temperature of coolant exiting the engine; and the flow rate adjustment module determines the coolant flow rate adjustment based on the desired coolant temperature and the measured temperature of coolant exiting the engine.

11. A method comprising:

determining a rate of heat transfer from an engine to coolant flowing through the engine based on a cylinder wall temperature and a measured coolant temperature;

determining a desired rate of coolant flow through the engine based on the heat transfer rate;

determining a coolant flow rate adjustment based on a desired coolant temperature and the measured coolant temperature; and controlling a coolant pump to adjust an actual rate of coolant flow through the engine based on the desired coolant flow rate and the coolant flow rate adjustment.

12. The method of claim 11 further comprising controlling the coolant pump to adjust the actual coolant flow rate to a sum of the desired coolant flow rate and the coolant flow rate adjustment.

13. The method of claim 11 further comprising determining the heat transfer rate based on a desired rate of heat rejection from the engine minus:

a rate of change in heat absorbed by the engine; and a rate of change in heat absorbed by coolant flowing through the engine.

14. The method of claim 13 further comprising determining the desired rate of heat rejection from the engine based on a speed of the engine and at least one of a desired torque output of the engine and an amount of air delivered to a cylinder of the engine.

15. The method of claim 13 further comprising determining the rate of change in heat absorbed by the engine based on a product of:

a cylinder wall mass;

a cylinder wall specific heat;

a change in the cylinder wall temperature; and a period associated with the change in the cylinder wall temperature.

16. The method of claim 13 further comprising determining the rate of change in heat absorbed by coolant flowing through the engine based on a product of:

a coolant mass;

a coolant specific heat;

a change in the measured coolant temperature; and a period associated with the change in the measured coolant temperature.

17. The method of claim 11 further comprising determining the heat transfer rate based on a product of:

a heat transfer coefficient of a cylinder wall of the engine;

a surface area of the cylinder wall; and a difference between the cylinder wall temperature and the measured coolant temperature.

18. The method of claim 11 further comprising determining the heat transfer rate based on a product of:

an effective heat transfer coefficient of a cylinder wall of the engine; and a difference between the cylinder wall temperature and the measured coolant temperature.

19. The method of claim 11 further comprising estimating the cylinder wall temperature based on engine operating conditions.

20. The method of claim 11 further comprising:

determining the heat transfer rate based on the cylinder wall temperature and an average value of a measured temperature of coolant entering the engine and a measured temperature of coolant exiting the engine; and determining the coolant flow rate adjustment based on the desired coolant temperature and the measured temperature of coolant exiting the engine.

* * * * *